US007290693B2

(12) United States Patent
Cheng

(10) Patent No.: US 7,290,693 B2
(45) Date of Patent: Nov. 6, 2007

(54) CABLE HOLDING ASSEMBLY FOR CABLE STAPLER

(76) Inventor: Li-Jung Cheng, No. 10-1, Lane 5, Shu I, South Dist., Taichung City (TW)

( * ) Notice: Subject to any disclaimer, the term of this patent is extended or adjusted under 35 U.S.C. 154(b) by 0 days.

(21) Appl. No.: 11/403,874

(22) Filed: Apr. 14, 2006

(65) Prior Publication Data

US 2007/0158383 A1 Jul. 12, 2007

(30) Foreign Application Priority Data

Jan. 9, 2006 (TW) ..... 95200515 U

(51) Int. Cl.
*B25C 5/00* (2006.01)

(52) U.S. Cl. ..... 227/29; 227/30; 227/31

(58) Field of Classification Search ..... 227/30, 227/120, 132, 123, 151–153, 8, 110
See application file for complete search history.

(56) References Cited

U.S. PATENT DOCUMENTS 2,746,043 A * 5/1956 Zaller ..... 227/127
2,775,763 A * 1/1957 Flammer ..... 227/77
3,347,439 A * 10/1967 Doherty ..... 227/109
4,380,312 A * 4/1983 Landrus ..... 227/116
4,552,296 A * 11/1985 Sheng ..... 227/109
6,082,604 A * 7/2000 Dennis ..... 227/8
6,634,537 B2 * 10/2003 Chen ..... 227/140
6,698,642 B2 * 3/2004 Chen ..... 227/120

* cited by examiner

*Primary Examiner*—Rinaldi I. Rada
*Assistant Examiner*—Lindsay Low
(74) *Attorney, Agent, or Firm*—Leong C. Lei

(57) ABSTRACT

A cable holding assembly for cable staplers is provided, which is housed inside a slot in front of the muzzle of a cable stapler. The cable holding assembly contains a spring blade, a holder blade, and a resistance blade. The spring blade is configured on the wall of the slot to position the holder blade inside the slot but flexible enough to allow the holder blade to be removed and inserted. The holder blade is H-shaped, forming a first cable holding end and a second holding end at the top and the bottom for cables of different gauges respectively. When the holder blade is inserted into the slot, the bottom end of the resistance blade is pressed against the arched edge of the cable holding end at the top so that the other cable holding end is extended outside of the slot and the cable stapler for holding down the cable reliably.

6 Claims, 6 Drawing Sheets

CABLE HOLDING ASSEMBLY FOR CABLE STAPLER

BACKGROUND OF THE INVENTION (a) Technical Field of the Invention

The present invention generally relates to cable staplers, and more particularly to a cable holding assembly for cable staplers.

(b) Description of the Prior Art

When laying out power cables, telephone cables, network cables, or similar flexible cables, a certain kind of cable retainers are usually employed to fix the cables along their paths. The cable retainer usually contains a body having a cable groove at the bottom and a built-in nail for securing the body to the wall or floor, confining the cable inside the groove of the body. To increase the efficiency of cabling, there are also specialized cable staplers that directly punch specially configured staples to fix the cables to the wall or floor. Such a stapler usually has an inverted U-shaped cable holding piece in front of the muzzle to hold down the cable before firing a staple to fasten the cable.

However, cables have different gauges. For example, telephone or network cables have smaller gauges than those of the power cables. The cables also have different cross-sectional shapes such as circular or oval shapes. The cable holding piece of a cable stapler therefore cannot function as expected if its U-shaped notch does not match the gauge and cross-sectional shape of the cable being fixed. If the cable is too thin or too thick, the cable holding piece cannot hold the cable steadily and reliably.

Therefore, usually multiple cable staplers have to be prepared for operation on cables of various gauges. This not only adds to the cost of ownership but also reduces the cabling efficiency as multiple cable staplers have to be carried and swapped during the work.

SUMMARY OF THE INVENTION

The primary purpose of the present invention is to provide a cable holding assembly for cable staplers to fit cables of different gauges so as to reduce the cost of ownership and to increase the cabling efficiency.

The major characteristic of the present invention is that the cable holding assembly, housed inside a slot in front of the muzzle of the cable stapler, contains a spring blade, a holder blade, and a resistance blade. The spring blade is configured on the wall of the slot to position the holder blade inside the slot but flexible enough to allow the holder blade to be removed and inserted. The holder blade has an H-like shape, forming a first cable holding end and a second holding end at the top and the bottom for cables of different gauges respectively. When the holder blade is inserted into the slot, the bottom end of the resistance blade is pressed against the arched edge of the cable holding end at the top so that the other cable holding end is extended outside of the cable stapler.

The protruding cable holding end of the holder blade therefore can be used to hold down the cable reliably before firing a staple to fasten the cable into the wall or the floor. As such, instead of preparing different cable staplers, the present invention allows a single cable stapler to handle cables of various gauges by switching the holder blades.

The foregoing object and summary provide only a brief introduction to the present invention. To fully appreciate these and other objects of the present invention as well as the invention itself, all of which will become apparent to those skilled in the art, the following detailed description of the invention and the claims should be read in conjunction with the accompanying drawings. Throughout the specification and drawings identical reference numerals refer to identical or similar parts.

Many other advantages and features of the present invention will become manifest to those versed in the art upon making reference to the detailed description and the accompanying sheets of drawings in which a preferred structural embodiment incorporating the principles of the present invention is shown by way of illustrative example.

DETAILED DESCRIPTION OF THE PREFERRED EMBODIMENTS

The following descriptions are of exemplary embodiments only, and are not intended to limit the scope, applicability or configuration of the invention in any way. Rather, the following description provides a convenient illustration for implementing exemplary embodiments of the invention. Various changes to the described embodiments may be made in the function and arrangement of the elements described without departing from the scope of the invention as set forth in the appended claims.

Figure 1:
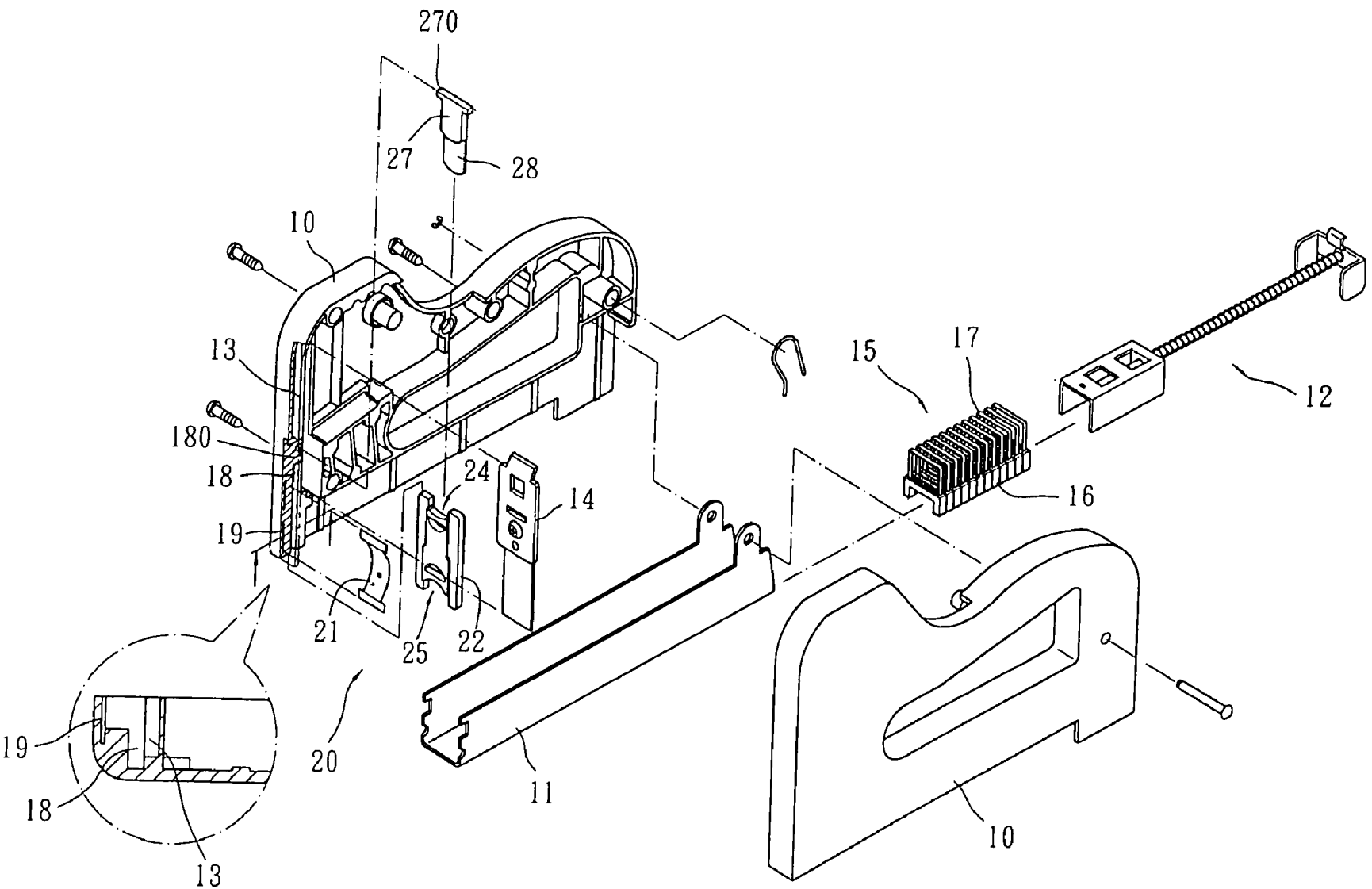
FIG. 1 is a perspective exploded view showing a cable holding assembly according to an embodiment of the present invention configured inside a cable stapler.

As shown in FIG. 1, a cable stapler has a hollow case formed by joining two correspondingly shaped casing pieces 10. Inside and at the bottom of the hollow case, an elongated magazine 11 having U-shaped cross-section is provided for accommodating an array of staples 15. Each of the staples 15 has a cable retaining body 16 and a built-in, inverted U-shaped nail 17 penetrating through the body 16. A spring-loaded pusher 12 is slidably configured at one end inside the magazine 11 to advance the array of staples 15 along and towards the other end (hereinafter, the front end) of the magazine 11. Inside the hollow case, there is a driving assembly (not numbered) in front of the magazine 11, which has a driving blade 14 slidably configured inside a track 13 perpendicular to the magazine 11. The foremost staple 15 of the magazine 11 is "fired" by sliding the driving blade 14 downward along the track 13. What has been described so far is identical to a conventional cable stapler arid therefore no further detail will be given.

Figure 2:
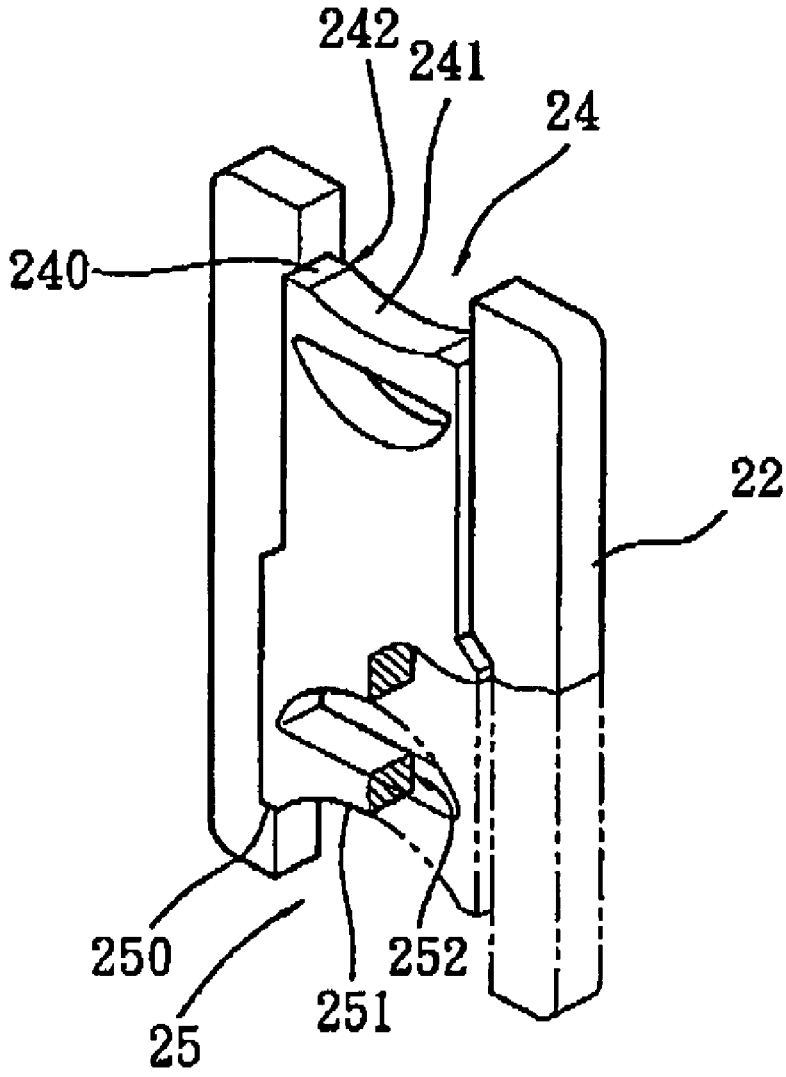
FIG. 2 is a perspective view showing the holder blade of the cable holding assembly of FIG. 1.
Figure 3:
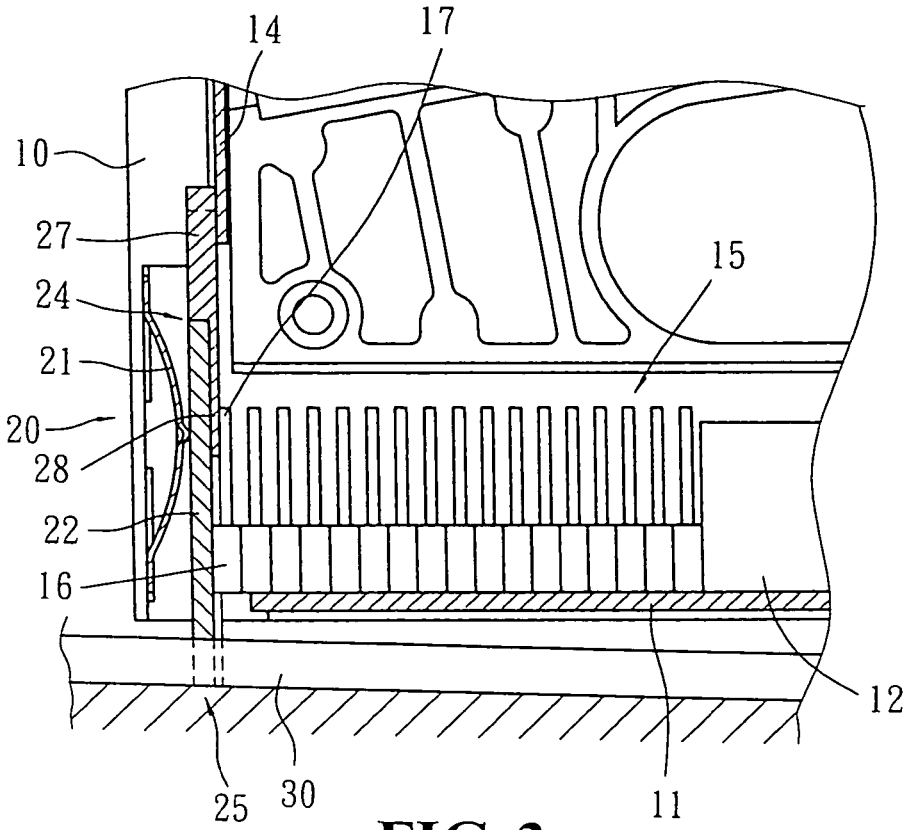
FIG. 3 is a sectional view of the cable holding assembly of FIG. 1 before a staple is fired at a cable which is held down by a second cable holding end of the holder blade.
Figure 4:
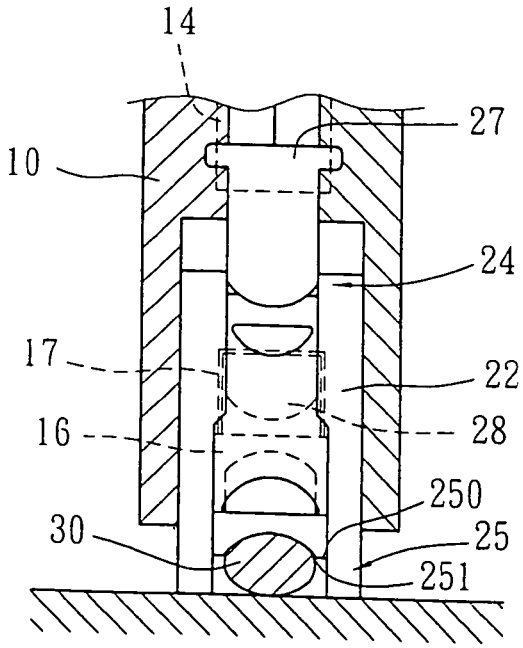
FIG. 4 is a front view of the cable holding assembly of FIG. 3.
Figure 5:
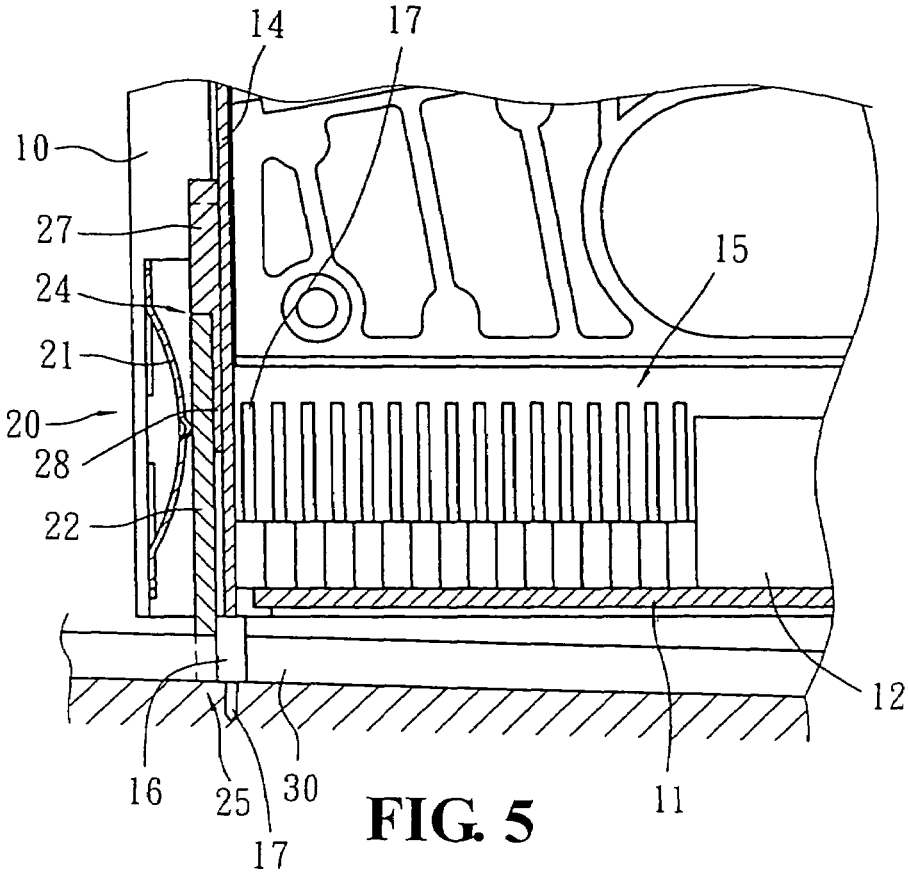
FIG. 5 is a sectional view of the cable holding assembly of FIG. 1 after a staple is fired at a cable which is held down by a second cable holding end of the holder blade.
Figure 6:
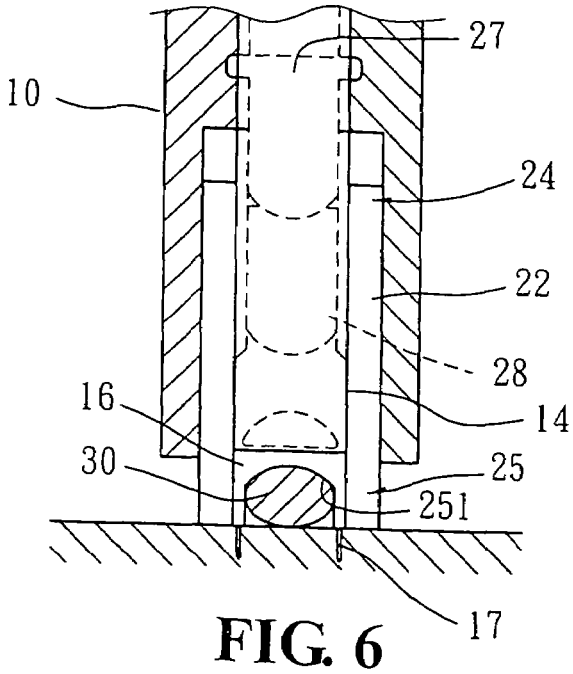
FIG. 6 is a rear view of the cable holding assembly of FIG. 5.

As to the major characteristics of the present invention, please also refer to FIGS. 2 to 4. As illustrated, a cable holding assembly 20 according to an embodiment of the present invention is provided, which is housed inside a flat slot 18 in front of and parallel to the track 13. The cable holding assembly contains a spring blade 21, a holder blade 22, and a resistance blade 27.

The slot 18 has an indentation 19 along its wall towards the front. The spring blade 21 is configured inside the indentation 19, bulging towards the inside of the slot 18 so as to press against and hold the holder blade 22 inside the slot 18. The spring blade 21 is flexible enough to allow the removal and insertion of the holder blade 22 from and into the slot 18. The slot 18 also has its top end extended upward to from a T-shaped compartment 180 for the accommodation of the T-shaped top portion 270 of the resistance blade 27.

The holder blade 22 has an H-like shape with its top and bottom ends forming a first cable holding end 24 and a second cable holding end 25, respectively. The first and second holding ends 24 and 25 have arched portions 240 and 250 of different heights, which in turn have arched edges 241 and 251 of different curvatures respectively. The first and second holding ends 24 and 25 therefore can be used to reliably hold cables of appropriate gauges and cross-sections. The middle section of the holder blade 22 is slightly protruding to one side and indented from the other side relative to the left and right edges. As such, the spring blade 21 can exert larger pressure to the protruding side, and the first and second holding ends 24 and 25 have indentations 242 and 252 at the other side, matching the form factors of the retaining bodies 16 of different types of stapes 15.

Figure 7:
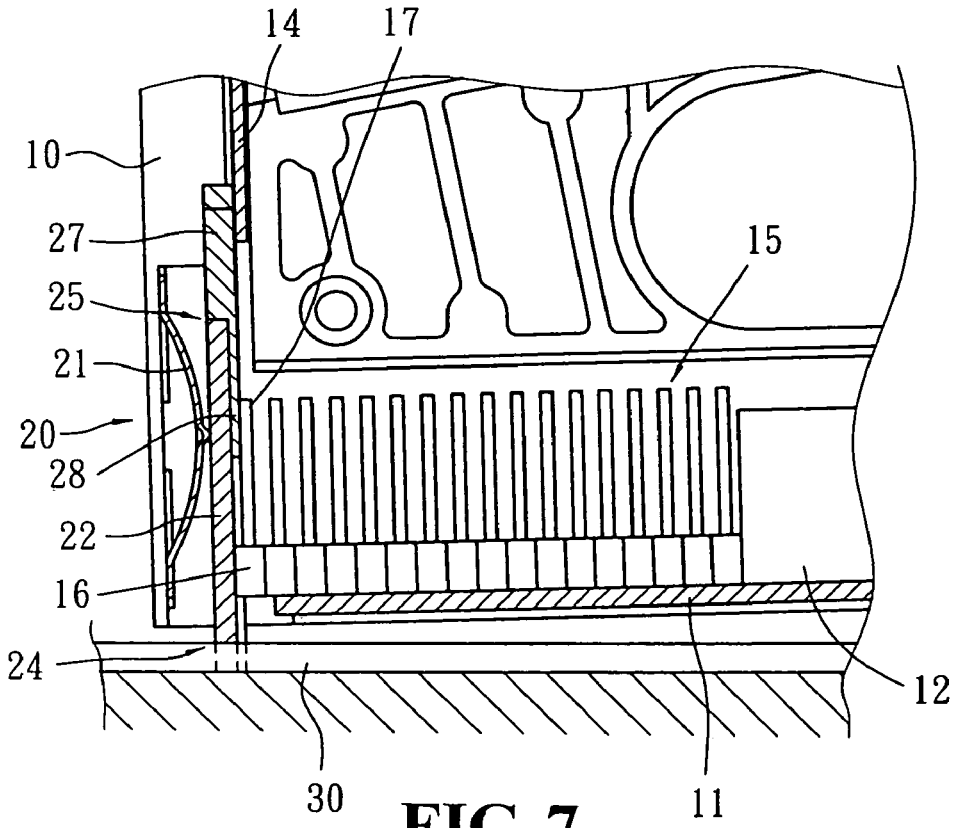
FIG. 7 is a sectional view of the cable holding assembly of FIG. 1 before a staple is fired at a cable which is held down by a first cable holding end of the holder blade.
Figure 8:
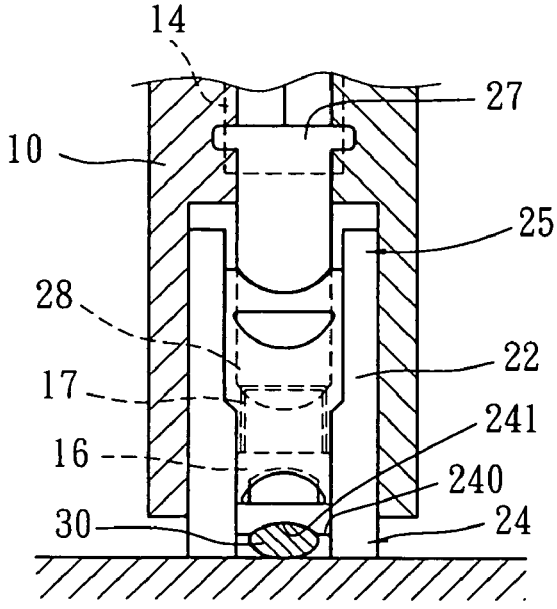
FIG. 8 is a front view of the cable holding assembly of FIG. 7.
Figure 9:
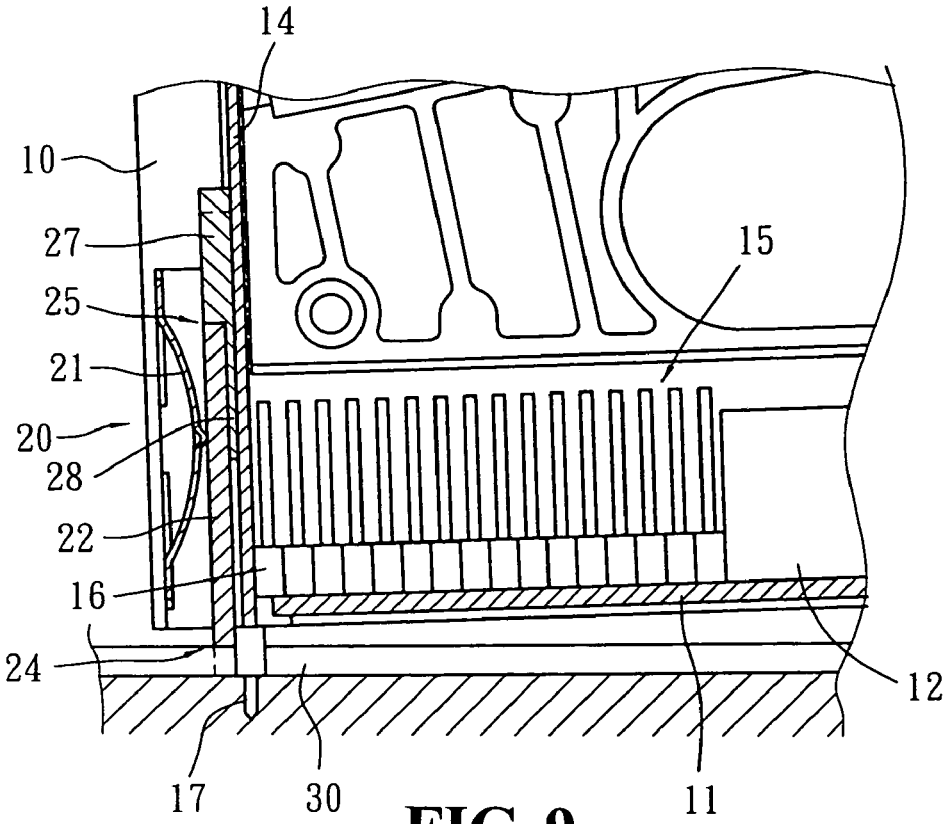
FIG. 9 is a sectional view of the cable holding assembly of FIG. 1 after a staple is fired at a cable which is held down by a first cable holding end of the holder blade.
Figure 10:
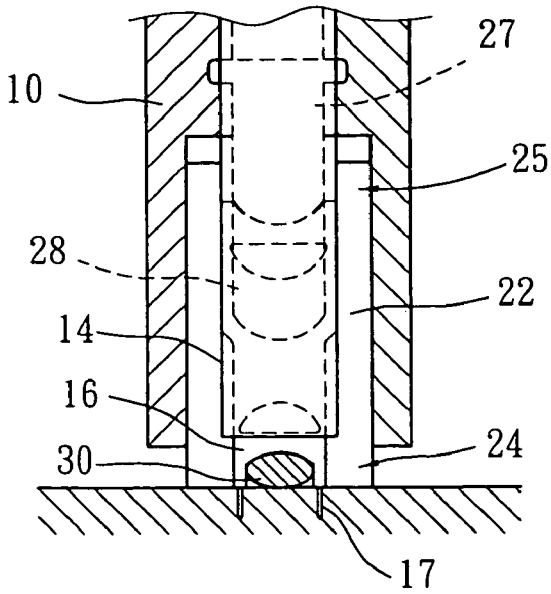
FIG. 10 is a rear view of the cable holding assembly of FIG. 9.

The downward-curved bottom edge of the resistance blade 27 is pressed against the downward-curved arched edge 241 of the first cable holding end 24 of the holder blade 22 so that the arched portion 250 of the second cable holding end 25 is extended out of the bottom of the slot 18 and the cable stapler as shown in FIGS. 3 and 7. A thinner blade 28 is extended from the bottom end of the resistance blade 27, which fits between the holder blade 22 and the nail 17 of a foremost staple 15 so that the nail 17 is aligned with the driving blade 14, as shown in FIG. 3. The driving blade 14 therefore can hit on the nail 17 accurately and reliably.

The application of the present invention is described as follows. First, a holder blade 22 having one of its cable holding ends 24 and 25 appropriate for the gauge of a cable 30 is selected. Assuming it is the second cable end 25, as shown in FIGS. 3 to 6, the holder blade 22 is inserted into the slot 18 with the second cable holding end 25 at the bottom. The arched edge 241 of the first cable holding end 24 is pressed against the bottom end of the resistance blade 27 and therefore the arched portion 250 is left outside of the slot 18 and the bottom of the cable stapler. As such, the cable 30 is held reliably by the arched portion 250 of the second cable holding end 25. When the cable stapler is engaged, the driving blade 14 slides down the track 13 to fire the foremost staple 15. The cable 30 is thereby fastened by the retaining body 16 with the nail 17 driven into the wall or the floor.

For another cable 30 having a different gauge matching the first cable holding end 24 of the holder blade 22, as shown in FIGS. 7 to 10, the holder blade 22 is removed and then reinstalled into the slot 18 after turning it up side down with the first cable holding end 24 at the bottom. Similarly, the arched edge 251 of the second cable holding end 25 is pressed against the resistance blade 27 and therefore the arched portion 240 is left outside of the slot 18 and the bottom of the cable stapler. Then, the cable 30 can be held reliably by the arched portion 240 of the first cable holding end 24 when a foremost staple 15 is fired.

As described, instead of preparing different cable staplers, the present invention allows a single cable stapler to handle cables of different gauges by installing an appropriate holder blade 22. In the mean time, according to the present invention, a single holder blade 22 can be used for two types of cables, one by one of its cable holding Ends. The cost of ownership and the operation efficiency are therefore greatly enhanced.

It will be understood that each of the elements described above, or two or more together may also find a useful application in other types of methods differing from the type described above.

While certain novel features of this invention have been shown and described and are pointed out in the annexed claim, it is not intended to be limited to the details above, since it will be understood that various omissions, modifications, substitutions and changes in the forms and details of the device illustrated and in its operation can be made by those skilled in the art without departing in any way from the spirit of the present invention.

I claim:

1. A cable holding assembly for a cable stapler, said cable stapler having a magazine for accommodating an array of staples, and a driving blade running perpendicular to said magazine and driving a foremost staple out of said cable stapler, each of said staples having a retaining body and a built-in nail, said cable holding assembly housed inside a slot in front of and parallel to said driving blade, said cable holding assembly comprising:

a spring blade configured along the wall of said slot flexibly protruding into the inside of said slot;

a resistance blade positioned at a top of said slot;

at least a holder blade having an H-like shape with arched portions at two vertical ends, each having an appropriate height matching the gauge of a specific type of cable;

wherein, when said holder blade is inserted into said slot, said spring blade keeps said holder blade inside said slot and a curved bottom edge of said resistance blade is pressed against said arched portion at a top of said holder blade so that said arched portion at a bottom of said holder blade is extended out of said slot.

2. The cable holding assembly according to claim 1, wherein said resistance blade has a T-shaped top portion accommodated inside a matching T-shaped compartment at the top of said slot.

3. The cable holding assembly according to claim 1, wherein a middle section of said holder blade is protruding to one side of said holder blade.

4. The cable holding assembly according to claim 1, wherein a middle section of said holder blade is indented from one side of said holder blade, forming appropriate indentations at said arched portions, each of which matches the form factor of said retaining body of a specific type of staples.

5. The cable holding assembly according to claim 1, wherein a thinner blade is extended downward from a bottom end of said resistance blade; said thinner blade fits between said holder blade and said nail of a foremost staple in said magazine so tat said nail is aligned with said driving blade.

6. The cable holding assembly according to claim 1, wherein the bottom end of said resistance blade is curved downward so as to be pressed against said arched portion at a top of said holder blade.

* * * * *